US005400486A

United States Patent [19]

Dobbins et al.

[11] Patent Number: 5,400,486

[45] Date of Patent: Mar. 28, 1995

[54] APPARATUS AND METHOD FOR BLENDING YARN STRANDS

[75] Inventors: Donald J. Dobbins, Waxhaw, N.C.; Klaus Gerhards, Huckeswagen, Germany

[73] Assignee: Barmag AG, Remscheid, Germany

[21] Appl. No.: 270,783

[22] Filed: Jul. 5, 1994

Related U.S. Application Data

[63] Continuation of Ser. No. 921,526, Jul. 29, 1992, abandoned.

[30] Foreign Application Priority Data

Feb. 22, 1992 [DE] Germany ..... 42 05 481.8

[51] Int. Cl.[6] ..... D02G 3/24

[52] U.S. Cl. ..... 28/253; 28/217; 28/220

[58] Field of Search ..... 28/252, 250, 251, 244, 28/219, 220, 243, 253, 258, 270, 289, 299, 221, 245, 240, 217, 246; 57/206, 352, 314; 242/43, 158 R, 158.1, 158.2, 158.3, 158.4 R, 158.5; 264/103, 177.17; 425/DIG. 17, 445; 226/158, 165, 182

[56] References Cited

U.S. PATENT DOCUMENTS

| | | | |
|---|---|---|---|
| 3,328,863 | 7/1967 | Cobb | 28/252 X |
| 3,479,810 | 11/1969 | Eshuis . | |
| 3,654,677 | 4/1972 | Binford et al. . | |
| 3,680,303 | 8/1972 | Kim . | |
| 3,924,311 | 12/1975 | Stanley . | |
| 3,978,560 | 9/1976 | Stanley . | |
| 4,042,662 | 8/1977 | Corbin | 28/244 X |
| 4,341,063 | 7/1982 | Southerlin et al. . | |
| 4,526,808 | 7/1985 | Strohmaier . | |
| 4,567,720 | 2/1986 | Price | 28/252 X |
| 4,899,426 | 2/1990 | Hand | 28/252 |
| 5,054,173 | 10/1991 | Schafer . | |

FOREIGN PATENT DOCUMENTS

| | | |
|---|---|---|
| 0133198 | 4/1984 | European Pat. Off. . |
| 3941737 | 6/1991 | Germany . |
| 1534587 | 12/1978 | United Kingdom . |

*Primary Examiner*—Clifford D. Crowder
*Assistant Examiner*—Larry D. Worrell, Jr.
*Attorney, Agent, or Firm*—Bell, Seltzer, Park & Gibson

[57] ABSTRACT

An apparatus for forming a blended yarn from a plurality of yarn strands is disclosed, and wherein the yarns are advanced to contact the surface of a feed roll in a side by side arrangement. A guide roll for each of the yarn strands is positioned upstream of the feed roll, and one or more of the guide rolls has a circumferential configuration which serves to repeatedly move the advancing yarn strands relative to each other so that the strands laterally cross each other on the surface of the feed roll in a predetermined pattern.

17 Claims, 1 Drawing Sheet

APPARATUS AND METHOD FOR BLENDING YARN STRANDS

This is a continuation of application Ser. No. 07/921,526, filed on Jul. 29, 1992, now abandoned.

BACKGROUND OF THE INVENTION

The present invention relates to an apparatus for forming a blended yarn from a plurality of yarn strands.

In the manufacture of a blended yarn from two or more multi-filament yarn strands of different colors or dyeability, it is known to supply the individual strands to a common take-up bobbin such that the strands advance in a parallel side by side arrangement to the take-up bobbin and are wound thereon. This process however often leads to the presence of unsightly streaks in the fabric produced from the resulting blended yarn. It is also known that such streaks can be avoided or at least reduced by periodically changing the relative arrangement of the individual yarn strands in short time intervals as they are advanced to the take-up bobbin.

A prior attempt to reduce unsightly streaks of the described type is disclosed in EP 0 133 198 A2, which relates to a method of making an untwisted crimped yarn from at least two yarn strands of different color and dyeability. The process disclosed in this application is intended to prevent unsightly streaks in that at least one of the yarn strands is alternately moved to opposite sides of another of the yarn strands. To effect such movement, traversing yarn guides or slotted drums are proposed. However, these disclosed embodiments involve considerable expenditure, and impart a substantial stress to the individual yarn strands. Likewise, the threading of the yarn strands on the drawing and texturizing machines subsequent to the yarn shifting device has caused problems for the operating personnel.

It is accordingly an object of the present invention to provide an apparatus and method for forming a blended yarn from a plurality of yarn strands which avoids the limitations and disadvantages of the prior processes noted above.

It is a more particular object of the present invention to provide an apparatus and method of the described type which includes a simple and yarn protecting apparatus for laterally displacing the individual yarn strands.

SUMMARY OF THE PRESENT INVENTION

The above and other objects and advantages of the present invention are achieved in the embodiments illustrated herein by the provision of an apparatus and method for forming a blended yarn from a plurality of yarn strands, and which comprises means for advancing a plurality of yarn strands in a generally parallel arrangement along a path of travel, a feed roll rotatably mounted along the path of travel so as to define a feed roll axis, with the feed roll axis being oriented so that the advancing yarn strands contact the surface of the feed roll in a side by side arrangement, and guide roll means positioned along the path of travel upstream of the feed roll for repeatedly moving at least one of the advancing yarn strands laterally from the path of travel and then returning the same to the original path of travel, and so that the moving yarn strand repeatedly crosses at least one other of the advancing strands on the surface of the feed roll.

In the preferred embodiment, the guide roll means, which may also be referred to as a mixing wheel, comprises a guide roll for each of the yarn strands, with the each of the guide rolls being rotatably mounted about a common guide roll axis. The guide roll axis extends transversely to the path of travel and crosses the feed roll axis when viewed in projection along the direction of the path of travel.

More particularly, the arrangement of the axes of the guide rolls and the feed roll is such that they extend in two planes parallel to one another, and the axes cross one another, i.e. they slant relative to one another. This permits the yarn strands to shift laterally on the feed roll by a temporary moving in a direction approximately parallel to the surface of the feed roll and so as to place little stress on the yarn strand. To ensure that the yarn strands change position on the feed roll, the distance between the feed roll and the guide roll means is selected to be sufficiently short so that the yarn strand length displaced by the guide roll means safely reaches the feed roll before a displacement of the yarn strand in the reverse direction is initiated.

In one simple embodiment of the invention, the guide roll means is provided on its circumference with two grooves serving to guide the yarn strands of which only one is provided with a bottom having a displacement portion. The latter is dimensioned such that the yarn strand guided in this groove is shifted forward and back on the feed roll from one side of the undisturbed yarn strand to the other side thereof.

In the following, wherever mention is made of the cross section of the groove, or the cross section in connection with a groove or the grooves, the same will always relate to the shape of the bottom of the groove in the normal plane extending through the axis of the guide roll means.

The cross section of the guide roll means, which contains one or more grooves with a yarn displacement portion, may have different shapes. In the simplest case, its shape is eccentric, i.e., it has the shape of a circle whose center is spaced from the axis of the guide roll. The extent of eccentricity determines the amount of the displacement.

In another embodiment, the groove with the yarn displacement portion may also have the shape of an ellipse or of an oval in the normal plane of the guide roll means. The arrangement of this cross sectional shape may be made, for example, in a manner that one of the foci of the ellipse is located on the axis of the guide roll means. When the center of the ellipse coincides with this axis, two displacement strokes will result during one rotation of the guide roll means, which may be desired in certain cases.

In still another embodiment, the groove describes a circle concentric with the guide roll axis, from which a cam extends, and which forms the yarn displacement portion. In the circumferential direction, this cam must have an extension which suffices to keep the yarn strand in the displaced position at least until the beginning of the displaced yarn length reaches the feed roll. Therefore, the minimum extension depends substantially on the distance between the guide roll means and the feed roll, and should, in general, cover an angle of at least about 60°. Preferably, the cam extends over an angle of about 80° to 170°, and, in particular, over an angle of about 90° to 160°. To avoid having the yarn strands interfere with each another on the guide roll means, it is useful to cover the grooves on the side toward adjacent grooves or toward the end of the guide roll means.

Likewise, the radial distance between the locations of the smallest and the greatest distance of the groove bottom from the guide roll axis may be determined within relatively wide limits. It depends on the yarn speed, the spacing between the guide roll means and the feed roll, the rotational speed of the guide roll means and in particular also on the denier as well as the bulk of the yarn. Thus, in the case of smooth yarns, the difference may be smaller than in the case of textured, for example, crimped yarns or air-jet textured loop yarns. Therefore, the values may range from about 5 mm to 25 mm, and preferably from about 8 mm to 20 mm.

The number of the grooves is preferably not smaller than the number of the individual yarn strands forming the blended yarn, with each groove being in this instance provided with a displacement portion. As a rule, the grooves of the guide roll means correspond to one another in their geometrical shape. However, in certain cases it may be useful to impart to each groove a different shape, if need arises. Preferably, in each case the displacement portions of the individual grooves are distributed at substantially the same angular distance among themselves over the circumference of the guide roll means. However, even here irregularities may be desired under certain circumstances.

BRIEF DESCRIPTION OF THE DRAWINGS

Some of the objects and advantages of the present invention having been stated, others will appear as the description proceeds, when taken in connection with the accompanying drawings, in which.

DETAILED DESCRIPTION OF THE PREFERRED EMBODIMENTS

Figures 1, 2, 3, 4, 5:
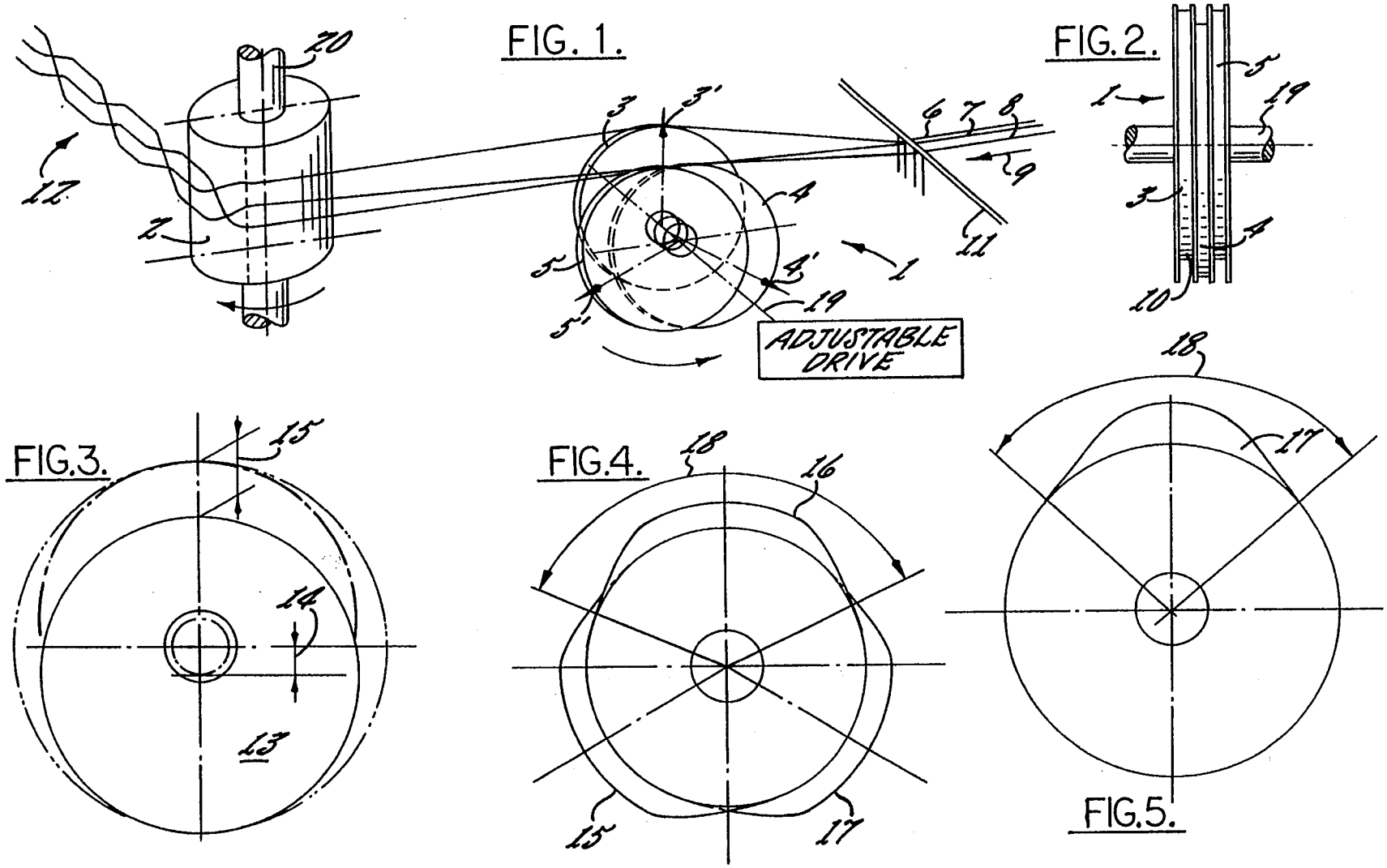
FIG. 1 is a schematic illustration of an apparatus for forming a blended yarn in accordance with the present invention.
FIG. 2 is a side elevation view of the guide roll mains of the apparatus of FIG. 1.
FIGS. 3–5 are end elevation views of the guide roll mains and illustrating three different cross sectional configurations of the grooves.

FIG. 1 schematically illustrates an apparatus for forming a blended yarn 12 from a plurality of yarn strands 6, 7 and 8 in accordance with a preferred embodiment of the present invention, and wherein the yarns are advanced in a generally parallel arrangement along a path of travel indicated by the arrow 9. The apparatus includes a comb 1, guide roll means 1, and a feed roll 2 which are serially positioned along the path of travel. The feed roll 2 defines a rotational axis 20, and the axis 20 is oriented so that the advancing yarn strands contact the surface of the roll 2 in a side by side arrangement. The guide roll means 1 acts to repeatedly move at least one of the advancing yarn strands laterally from the path of travel and so that the moving yarn strand crosses at least one other of the advancing strands on the surface of the feed roll 2.

The guide roll means 1 is rotatably driven by an adjustable drive as illustrated schematically in FIG. 1, and it defines an axis 19 which extends parallel to the plane of the yarn path formed by the advancing yarn strands 6–8, and the rotational axis 20 of the feed roll 2 is rotated out of the plane of the yarn path. The feed roll 2 is preferably driven so that its surface speed corresponds to the advancing speed of the yarn strands. The axes 19, 20 of guide roll means 1 and feed roll 2 thus extend in two different parallel planes and cross each other when viewed in projection along the path of travel. More particularly, they form an angle with one another, which should be not smaller than at least about 45°, and preferably in the range between about 60° and 90°.

The selection of an angle deviating from 90°, permits the behavior of the yarn strand contacting the feed roll 2 to be influenced. Whereas at an angle of 90° the non-deflected yarn strands 6–8 come randomly to lie side by side on the feed roll 2, an angle smaller than 90° favors the maintenance of the sequence of the yarn strands supplied side by side, which may be desired in the case of an orderly yarn strand displacement. However, in practice, this has turned out to be of subordinate importance.

Especially important is, as aforesaid, the spacing between guide roll means 1 and feed roll 2. Since a displacement of the yarn strand on the feed roll 2 can occur only when the deflection of the respective yarn strand continues until the beginning of the deflected yarn strand length reaches the surface of the feed roll, the spacing should be as short as possible, or the speed of the guide roll means should be selected correspondingly lower than the yarn strand speed.

The yarn comb 11 which precedes the guide roll means 1 acts to separate the yarn strands 6–8 supplied to the guide roll means 1. In the illustrated embodiment, the guide roll means 1 comprises three guide rolls 3, 4, 5, which correspond to the number of yarn strands to be blended. As best seen in FIG. 2, each of the guide rolls 3, 4, 5 has a circular groove 10 for receiving the associated yarn strand, and the circular grooves are eccentrically positioned about the axis 19 of the guide roll means 1. The eccentrically mounted grooves thus define displacement portions 3', 4', 5' respectively, which are located a greater distance from the guide roll axis than the remaining portions. Also the displacement portions 3, '4', 5', are separated from each other the same angular distance about the circumference of the guide roll means 1. In the case of three guide rolls 3, 4, 5, this angular distance equals 120°.

Along their path from the yarn comb 11 to the feed roll 2, the yarn strands 6–8 are guided in the grooves 10 of the guide rolls 3–5 and are temporarily raised in turn from the plane of the yarn path of travel. As a consequence, each raised yarn strand moves relative to the other yarn strands upward on the surface of the feed roll 2, and in doing so it crosses at least one of the other yearn strands or even both yarn strands. Upon its return to the plane of the yarn path, the yarn strand assumes again its initial position.

The extent and course of the deviation from the position occupied on the feed roll 2 without deflection, and the duration of the deflection are, apart from the yarn speed in relation to the angular velocity of the guide roll means 1, dependent on the shape and circumferential extent of the displacement portion of each guide roll. Thus, for example, the eccentric shape 13 (FIG. 3), i.e., the circular shape with an eccentricity 14 to the roll axis, leads to a constantly changing deflection between the idle position and the displaced position.

In contrast therewith, FIG. 4 illustrates an embodiment wherein each of the grooves 10 of the guide rolls is of generally elliptical outline, so as to define raised displacement portions 15, 16, 17, respectively. When the groove 10 of a guide roll is configured as illustrated in FIG. 4, the respective yarn strand 6, 7, or 8 reciprocates between two defined positions of contact on the feed roll 2. The yarn strand maintains the specific, deflected position respectively for a time interval determined by the circumferential angle 18 of the raised displacement portions 15, 16, 17, so as to then remain in its idle position for a time likewise influenced by the angle 18. As noted above, the angle 18 is preferably at least about 60° In one specific embodiment, the generally elliptical outline of each of the grooves 10 as seen in FIG. 4 may have one of its foci positioned to be coaxial with the axis 19 of the guide roll means 1.

In the configuration of the groove bottom shown in FIG. 5, the yarn strand guided in the groove of a guide roll 3, 4, or 5 is displaced by a cam 17 from its idle position respectively only for a short time determined by the circumferential angle 18 of the cam 17.

The configuration of the grooves 3 to 5 as illustrated in the drawing represents three of any desired number of possible embodiments. The selection of the cross sectional shape of the grooves of the rolls 3 to 5, when viewed in the normal plane to the roll axis, permits any desired form of lateral deflection of the yarn strands. For example, it is possible to obtain an irregular form of deflection, such as, perhaps, by providing a guide roll means 1 with different cross sectional shapes for the grooves. Therefore, the furnishing of the guide roll means 1 with grooves of the guide rolls 3 to 5 having the same cross section is only one possible embodiment.

The present invention is adapted for use in association with a treatment device for the blended yarn, such as a pneumatic stufferbox texturing device, which may be positioned between the feed roll 2 and a winding apparatus.

In the drawings and specification, there has been set forth a preferred embodiment of the invention, and although specific terms are employed, they are used in a generic and descriptive sense only and not for purposes of limitation.

That which is claimed is:

1. An apparatus for forming a blended yarn from a plurality of advancing yarn strands, and comprising means for guiding a plurality of advancing yarn strands in a generally parallel arrangement along a path of travel, a feed roll rotatably mounted along the path of travel so as to define a feed roll axis about which the feed roll is adapted to rotate, with the feed roll axis being oriented with respect to said path of travel so that the advancing yarn strands contact the surface of the feed roll in a side by side arrangement, and guide roll means positioned along said path of travel upstream of said feed roll for repeatedly moving at least one of the advancing yarn strands laterally from the path of travel and then returning the same to the original path of travel, and so that the moving yarn strand repeatedly crosses at least one other of the advancing strands on the surface of said feed roll, said guide roll means comprising a guide roll for each of said yarn strands, with each of said guide rolls being rotatably mounted about a common guide roll axis, and wherein said guide roll axis extends transversely to the path of travel of the yarn strands and crosses the feed roll axis when viewed in projection along the direction of the path of travel.

2. The apparatus as defined in claim 1 wherein each of said guide rolls has a circumferential displacement portion which is located at a greater radial distance from said guide roll axis than the remaining circumferential portion.

3. The apparatus as defined in claim 2 wherein said guide roll axis crosses the feed roll axis when viewed in projection along the direction of the path of travel at an angle of at least about 45 degrees.

4. The apparatus as defined in claim 3 wherein said guide roll axis crosses the feed roll axis at an angle of between about 45 and 90 degrees when viewed in projection along the direction of the yarn path of travel.

5. The apparatus as defined in claim 3 wherein each of said guide rolls includes a circumferential groove for receiving its associated yarn strand, with each circumferential groove including a displacement portion which is located a greater distance from said guide roll axis than the remaining portion thereof.

6. The apparatus as defined in claim 5 wherein all of said circumferential grooves are of like configuration and wherein the displacement portions of said guide rolls are equally distributed about the circumference of said guide roll means when viewed along said guide roll axis.

7. The apparatus as defined in claim 3 wherein each of said guide rolls includes a circumferential groove for receiving its associated yarn strand, with each circumferential groove defining a circle which is eccentrically positioned about said guide roll axis.

8. The apparatus as defined in claim 3 wherein each of said guide rolls includes a circumferential groove for receiving its associated yarn strand, with each circumferential groove defining an ellipse positioned about said guide roll axis.

9. The apparatus as defined in claim 3 wherein each of said guide rolls includes a circumferential groove for receiving its associated yarn strand, with each circumferential groove including a circular portion which is concentrically positioned about said guide roll axis and a displacement portion which is radially outside said circular portion.

10. The apparatus as defined in claim 9 wherein said displacement portion of each of said guide rolls extends over a circumferential angle of at least about 60 degrees.

11. The apparatus as defined in claim 10 wherein said displacement portion of each of said guide rolls is radially spaced from a circle defined by said circular portion by a distance of about 5 to 10 mm.

12. The apparatus as defined in claim 3 further comprising means for collectively driving said guide rolls for rotation about said guide roll axis at an adjustable speed.

13. A method of forming a blended yarn from a plurality of yarn strands, and comprising the steps of advancing a plurality of yarn strands in a generally parallel arrangement along a path of travel, contacting the advancing strands with the surface of a rotatable feed roll which is positioned along the path of travel so as to define a feed roll axis, and with the feed roll axis being oriented so that the advancing yarn strands contact the surface of the feed roll in a side by side arrangement, and repeatedly deflecting at least one of the advancing yarn strands laterally from the path of travel and returning the deflected yarn strand to the path of travel at a location upstream of the feel roll and so that the deflected yarn strand repeatedly crosses at least one other of the advancing yarn strands on the surface of said feed roll, and including guiding each of the advancing yarn strands into contact with a separate rotatable guide roll and while radially deflecting at least one of the advancing strands with respect to the rotational axis of the associated guide roll.

14. The method as defined in claim 13 wherein said guide rolls are mounted for rotation about a common axis, and wherein at least one of said guide rolls has a circumferential displacement portion which is located at a greater radial distance from said common axis than the remaining circumferential portion.

15. The method as defined in claim 14 comprising the further step of rotatably driving each of said guide rolls at a predetermined rotational speed.

16. The method as defined in claim 15 comprising the further step of coordinating the speed of the advancing yarn strands with the distance between said guide rolls and said feed roll so that a yarn strand length deflected by its associated guide roll reaches the feed roll before a displacement of such yarn strand in the reverse direction is initiated as a result of returning the deflected yarn strand to the path of travel.

17. An apparatus for forming a blended yarn from a plurality of advancing yarn strands, and comprising means for guiding a plurality of advancing yarn strands in a generally parallel arrangement along a path of travel, a feed roll rotatably mounted along the path of travel so as to define a feed roll axis about which the feed roll is a adapted to rotate, with the feed roll axis being oriented with respect to said path of travel so that the advancing yarn strands contact the surface of the feed roll in a side by side arrangement, and guide roll means positioned along said path of travel upstream of said feed roll for repeatedly moving at least one of the advancing yarn strands laterally from the path of travel and then returning the same to the original path of travel, and so that the moving yarn strand repeatedly crosses at least one other of the advancing strands on the surface of said feed roll, said guide roll means comprising at least one guide roll mounted for rotation about a guide roll axis and so that said at least one yarn strand is adapted to contact the circumferential periphery of said one guide roll, and with said one guide roll having a circumferential displacement portion on its periphery which is located at a greater radial distance from said guide roll axis than the remaining circumferential portion.

* * * * *